US012465153B2

(12) United States Patent
Groppel

(10) Patent No.: US 12,465,153 B2
(45) Date of Patent: Nov. 11, 2025

(54) REVERSIBLE MATTRESS TOPPER

(71) Applicant: DREAMWELL, LTD., Doraville, GA (US)

(72) Inventor: Stephen M. Groppel, Appleton, WI (US)

(73) Assignee: DREAMWELL, LTD., Doraville, GA (US)

( * ) Notice: Subject to any disclaimer, the term of this patent is extended or adjusted under 35 U.S.C. 154(b) by 0 days.

(21) Appl. No.: 17/379,186

(22) Filed: Jul. 19, 2021

(65) Prior Publication Data

US 2022/0369825 A1 Nov. 24, 2022

Related U.S. Application Data

(60) Provisional application No. 63/189,975, filed on May 18, 2021.

(51) Int. Cl.
*A47C 27/00* (2006.01)
*A47C 21/04* (2006.01)

(52) U.S. Cl.
CPC ..... *A47C 21/046* (2013.01); *A47C 27/002* (2013.01)

(58) Field of Classification Search
CPC ..... A47C 21/046; A47C 27/002; A47C 27/00
See application file for complete search history.

(56) References Cited

U.S. PATENT DOCUMENTS

| | | | | |
|---|---|---|---|---|
| 9,962,008 | B1 * | 5/2018 | Omiste | A47C 21/048 |
| 2011/0072591 | A1 * | 3/2011 | Fang | A47C 31/105 5/737 |
| 2012/0193572 | A1 * | 8/2012 | MacKay | C09K 5/063 252/79 |
| 2014/0039082 | A1 * | 2/2014 | Peterson | A47G 9/1036 521/50 |
| 2016/0066716 | A1 * | 3/2016 | Rao | A61B 5/6814 600/26 |
| 2017/0208958 | A1 * | 7/2017 | Alletto, Jr. | A47C 21/046 |
| 2018/0249841 | A1 * | 9/2018 | Omiste | A47C 21/048 |
| 2018/0298264 | A1 * | 10/2018 | Peterson | C09K 5/14 |
| 2019/0017200 | A1 * | 1/2019 | Alletto, Jr. | D02G 3/40 |
| 2020/0397148 | A1 * | 12/2020 | Elliott | A47C 21/048 |
| 2021/0120967 | A1 * | 4/2021 | Murphy | A47C 27/15 |
| 2021/0212474 | A1 * | 7/2021 | Chunglo | A47C 27/22 |
| 2022/0232994 | A1 * | 7/2022 | Kulik | A47C 27/148 |

* cited by examiner

*Primary Examiner* — Fredrick C Conley
(74) *Attorney, Agent, or Firm* — CANTOR COLBURN LLP

(57) ABSTRACT

A reversible mattress topper for a mattress is provided that includes opposing first and second panels. A fill material is intermediate the first and second panels. The panel materials and/or selected portions of the filler material will be selected to provide either cooling or comfort for the sleeper. One surface of the reversible mattress topper will be configured to be cooling in nature. The other surface of the reversible mattress will be comforting and optionally warming in nature. The panels can be stylized in order to communicate which surface provides cooling and which surface provides warming.

12 Claims, 1 Drawing Sheet

REVERSIBLE MATTRESS TOPPER

CROSS REFERENCE TO RELATED APPLICATIONS

The present application claims the benefit of U.S. Provisional Application No. 63/189,975 filed on May 18, 2021, and incorporated herein in its entirety.

BACKGROUND

The present disclosure generally relates to bedding, and more particularly to mattress toppers adapted to provide added comfort and functionality to an end user.

Individuals spent approximately ⅓ of their lives sleeping. Sleep is therefore extremely important for people to be the best person they can be. It is important that individuals use a bedding system that provides the necessary environment for the best sleep.

Typically, a bed sheet is fitted on top of a mattress where one or more individuals sleep upon. These individuals further augment their bedding system with any combination of top sheets, comforters, weighted sleep aid, blankets, etc. These additions atop the sleeper depend on the environment they are sleeping. Typically, less materials in summer months and more materials in winter months. Additionally, individuals may add a mattress topper between the fitted sheet and the mattress to provide additional cushioning comfort.

BRIEF SUMMARY

Disclosed herein are reversible mattress toppers for use with mattresses. In eon or more embodiments, a reversible mattress topper includes a first surface defined by a first panel, wherein the first surface is configured to provide a cooling effect to an end user in contact therewith; a second surface defined by a second panel opposing the first surface that does not provide the cooling effect; and a filler material intermediate the first and second panels.

In one or more embodiments, a reversible mattress topper includes first fabric panel comprising a phase change material having a melting point in a range of about 22° C. to about 40° C.; a second fabric panel free of the phase change material, wherein the first fabric panel and the second fabric panel are peripherally bound together; and a filler material comprising foam, padding, microcoils, or a combination thereof intermediate the first and second fabric panels.

In still one or more embodiments, a reversible mattress topper includes a first panel; a second panel, wherein the first panel and the second panel are peripherally bound together; and a filler material intermediate the first and second panels, wherein a selected surface of the filler material proximate to a surface of the first panel or the second panel comprises a phase change material having a melting point in a range of about 22° C. to about 40° C., and the other surface is free of the phase change material.

The disclosure may be understood more readily by reference to the following detailed description of the various features of the disclosure and the examples included therein.

BRIEF DESCRIPTION OF FIGURES

Referring now to the figures wherein the like elements are numbered alike.

DETAILED DESCRIPTION

Figure 1:
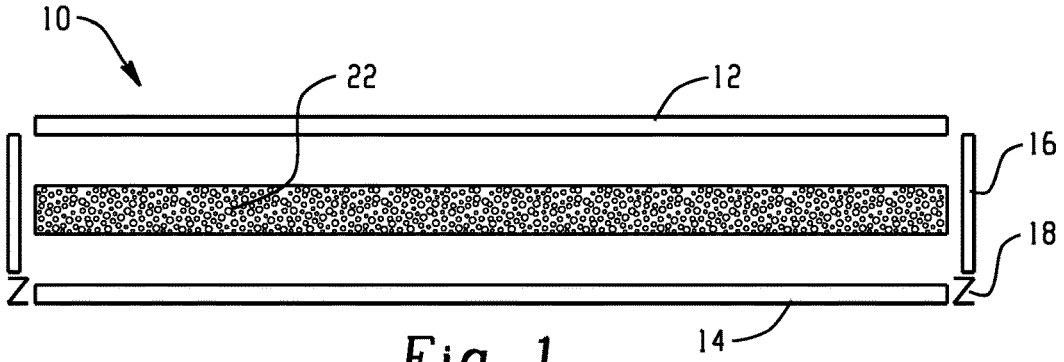
FIG. 1 illustrates an exploded sectional view of a reversible topper layer for use with a mattress assembly in accordance with the present disclosure.

Disclosed herein are reversible mattress toppers configured to overlay an underlying mattress. The reversible mattress toppers generally include a first panel, a second panel, and a filler material intermediate the first and second panels. One surface of the reversible mattress topper is configured to provide cooling and the other surface is configured to provide comfort and warmth to the end user as will be described in greater detail below. In this manner, the end user can select an appropriate surface as its desired sleep surface. Advantageously, this permits the end user to readily and easily select a cooling surface such as may be desired in warmer climates and a comfort and warmth surface such as may be desired in colder climates.

Conventional techniques related to manufacturing processes for mattress toppers and mattresses in general may or may not be described in detail herein. Moreover, the various tasks and process steps described herein can be incorporated into a more comprehensive procedure or process having additional steps or functionality not described in detail herein. In particular, various steps in the manufacture of mattress components such as the use of stitching, application of adhesives assembly steps, and the like are well known and so, in the interest of brevity, many conventional steps will only be mentioned briefly herein or will be omitted entirely without providing the well-known process details.

For the purposes of the description hereinafter, the terms "upper", "lower", "top", "bottom", "left," and "right," and derivatives thereof shall relate to the described structures, as they are oriented in the drawing figures. The same numbers in the various figures can refer to the same structural component or part thereof. Additionally, the articles "a" and "an" preceding an element or component are intended to be nonrestrictive regarding the number of instances (i.e. occurrences) of the element or component. Therefore, "a" or "an" should be read to include one or at least one, and the singular word form of the element or component also includes the plural unless the number is obviously meant to be singular.

Spatially relative terms, e.g., "beneath," "below," "lower," "above," "upper," and the like, can be used herein for ease of description to describe one element or feature's relationship to another element(s) or feature(s) as illustrated in the figures.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

As used herein, the term "about" modifying the quantity of an ingredient, component, or reactant of the invention employed refers to variation in the numerical quantity that can occur, for example, through typical measuring and liquid handling procedures used for making concentrates or solutions. Furthermore, variation can occur from inadvertent error in measuring procedures, differences in the manufacture, source, or purity of the ingredients employed to make the compositions or carry out the methods, and the like.

It will also be understood that when an element, such as a layer, region, or substrate is referred to as being "on" or "over" another element, it can be directly on the other element or intervening elements can also be present. In contrast, when an element is referred to as being "directly on" or "directly over" another element, there are no intervening elements present, and the element is in contact with another element.

Figure 2:
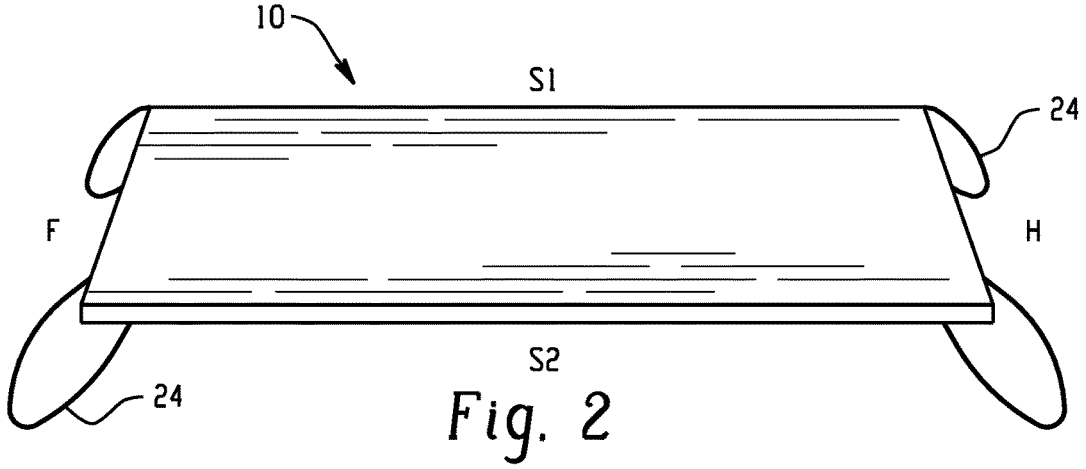
FIG. 2 illustrates a perspective view of a reversible mattress topper in accordance with the present disclosure.

Referring now to FIGS. 1 and 2, there are depicted exploded and perspective views, respectively, of a reversible mattress topper generally designated by reference numeral 10 in accordance with the present disclosure. The reversible topper layer 10 is dimensioned to overlay the uppermost user-facing surface of a mattress assembly (not shown) in its entirety. Typically, the reversible mattress topper 10 is generally rectangular shaped like the underlying mattress as is generally shown in the perspective view of FIG. 2. As such, the reversible mattress topper 10 generally has a head end (H), a foot end (F) and lateral sides (S1), (S2) extending from the head end H to the foot end (F). However, it should be apparent that other shapes are contemplated to accommodate irregular shaped mattresses, e.g., custom mattresses such as circular beds or the like. In use, the reversible mattress topper layer 10 is configured to be positioned between a mattress and a bed sheet that is positioned over the mattress and the mattress topper.

Figure 3:
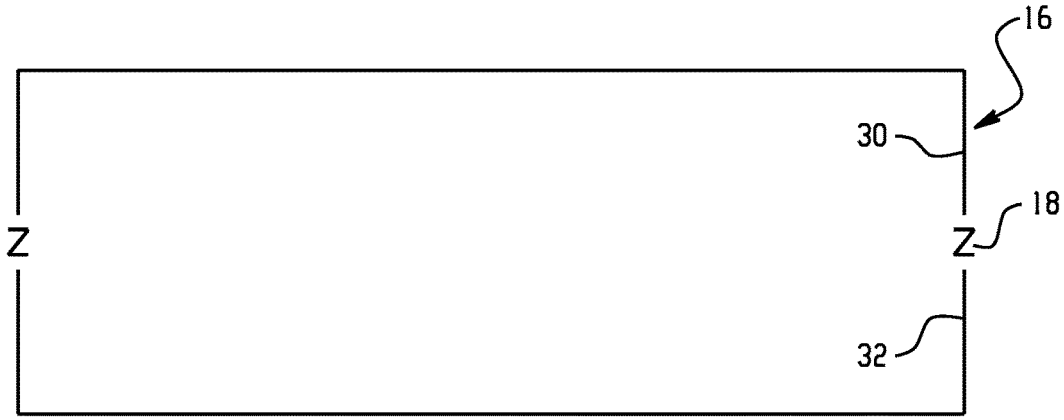
FIG. 3 illustrates a sectional view of the reversible topper including a zippered opening in a gusset material attached to first and second panels in accordance with the present disclosure.

Referring now to FIG. 1, the reversible mattress topper 10 includes a first panel 12, a second panel 14, a gusset material 16 joining the first panel 12 to the second panel 14, and an optional zippered fastener 18 for joining the gusset material 16 to a selected one of the first and second panels 12, 14 so as to provide an openable and closable opening to an interior of the mattress topper. Alternatively, as shown in FIG. 3, the gusset material 16 can include a first portion 30 and a second portion 32 with the zippered fastener 18 attached to the first and second portions, 30, 32, respectively, wherein ends of the first and second portions distally located from the zippered fastener 18 are sewn to the first and second panels. Still further, in one or more other embodiments, the gusset material 16 can be omitted (not shown) and the zippered fastener 18 can be directly attached to the first and second panels 12, 14 to provide an openable and closable opening therebetween. The zippered fastener 18 can continuously extend about the perimeter of the reversible topper layer 10 in its entirety, or in other embodiments, the zippered fastener 18 can partly extend about a selected one or more of the sides (S1), (S2), the head end (H), and the foot end (F) or the mattress topper. In some embodiments, the zippered fastener is omitted and the first and second panels are sewn together to encapsulate the filler material such that there is no openable and closable access to the interior of the mattress topper 10.

In one or more embodiments, a selected one of the panels 12 or 14 is configured to provide cooling and the other panel is configured to provide comfort and/or warmth. Cooling can be provided by use of cooling chemistry such as through the use of phase change materials. The other panel would not be provided with the cooling chemistry. As will be described in greater detail below, a surface of the selected panel can be impregnated or coated with one or more desired phase change materials or the fabric itself defining the selected panel can be formed from fibers having a phase change material integrated within the individual fibers. The phase change material can be uniformly provided on the surface of the selected panel or can be provided in a pattern to define cooling zones about the surface. In this manner, an end user in proximal contact with the surface of the panel provided with the phase change material would experience cooling or warmth if in proximal contact with the surface of the panel without the phase change material.

The first and second panels 12, 14 are generally formed of a flexible and washable fabric. Depending on the cooling chemistry, the fabric defining the first and second panels can be the same or different. In one embodiment, the reversible topper layer is quilted.

As noted above, the mattress topper 10 includes a filler material 22 that is generally sandwiched between the first and second panels 12, 14. In the one or more embodiments including the zippered opening, the filler material 22 is removable to provide the end user with the capability to wash (or replace) the filler material by itself or with the first and/or second panel and the gusset material, if the gusset material is utilized in the reversible topper layer 10.

The filler material 22 can be formed of a fiber mat, a foam, a plurality of microcoils, or a combination thereof. In one or more embodiments, a selected exterior surface of the filler material 22 is coated with the cooling chemistry, e.g., phase change material and is sandwich between panels 12, 14, wherein neither panel is provided with the cooling chemistry. As such, an end user would still experience selective warmth or cooling depending on the orientation of the mattress topper and the proximity of the filler material surface with the cooling chemistry to the end user.

As shown in FIG. 2, the mattress topper 10 can further include an elastic band 24 at about each corner configured to engage a corresponding corner of the underlying mattress assembly. In this manner, the reversible topper layer 10 can be configured to be easily secured or removed to the underlying mattress.

As noted above, a surface of a selected one of the panels 12 or 14 and/or a selected surface of the filler material 22 can be provided with cooling chemistry, which can include deposition of an appropriate cooling chemistry onto a surface thereof, fabrication of the panel from fibers configured to provide cooling, or fabrication of the panel from a natural cooling material. Exemplary cooling chemistries include, but is not intended to be limited to, application of phase change materials, thermally conductive materials, or the like.

Figure 4:
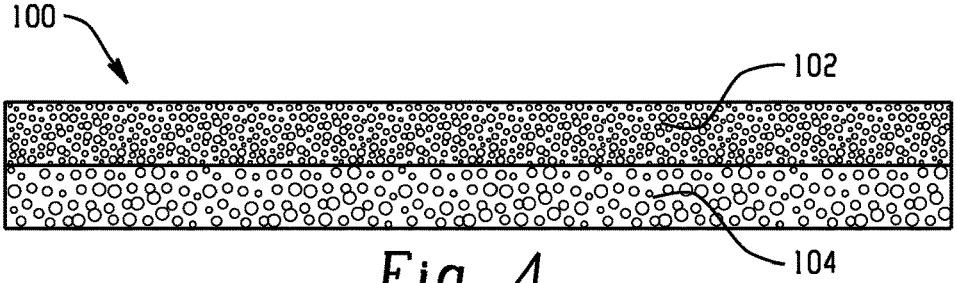
FIG. 4 illustrates a sectional view of a reversible mattress topper in accordance with the present disclosure.

In one or more embodiments, the filler material is formed of two foam panels as shown in the reversible mattress topper depicted in FIG. 4. The reversible mattress topper 100 includes a first foam layer 102 and a second foam layer 104 affixed to one another such as by an adhesive or the like. The first foam layer 102 is configured to provide cooling properties and the second foam panel 104 is configured to provide warmth and/or comfort. The first foam layer and the second foam layer can be formed of different foams and/or have different properties, e.g., different densities, hardness, porosities, thicknesses, or the like. In one embodiment, the first foam layer 102 is of an open cell foam construction, which can include a partially or a fully reticulated foam structure whereas the second foam panel 104 is formed of a closed cell foam. The term reticulation generally refers to removal of cell membranes to create the open cell structure such that the foam layer is open to air (and moisture) flow.

During use and depending on which foam layer is most proximate to the end user, the open cell foam construction of the first foam panel 102 will provide increased airflow therethrough to provide a cooling sensation to the end user. In contrast, the closed cell foam of the second foam layer 104 retains heat from the end user since air flow through the layer is prevented. In one or more embodiments, the first foam layer 102 can further include cooling chemistries as is generally described herein and/or the second layer can further include warming elements to further warm the surface during use. The reversible mattress topper can include a cover encapsulating the first and second foam layers as previously described. Still further, the foams may be gel infused, include conductive materials, include phase change materials, or other additives in some embodiments. The different layers can be formed of the same material configured with different properties or different materials.

In one or more embodiments, cooling is provided using a phase change material (PCM). The term "phase change" is generally used to describe a reversible process in which a solid turns into a liquid or a gas. The process of phase change from a solid to a liquid requires energy to be absorbed by the solid. When a PCM liquefies, energy is absorbed from the immediate environment as it changes from the solid to the liquid. In contrast to a sensible heat storage material, which absorbs and releases energy essentially uniformly over a broad temperature range, a phase change material absorbs and releases a large quantity of energy in the vicinity of its melting/freezing point. Therefore, a PCM that melts below body temperature would feel cool as it absorbs heat, for example, from a body. Phase change materials, therefore, include materials that liquefy (melt) to absorb heat and solidify (freeze) to release heat. The melting and freezing of the material typically take place over a narrow temperature range.

Suitable phase change materials are microencapsulated phase change materials, which are generally a known in the art, and in the present disclosure can incorporated in the fabric of the selected panel or filler material surface in accordance with various embodiments of the disclosure or deposited on a panel surface. PCMs can include a variety of organic and inorganic substances including paraffins; bio-phase change materials derived from acids, alcohols, amines, esters, and the like; salt hydrates; and the like. The particular phase change material or mixtures thereof are not intended to be limited.

Exemplary phase change materials include hydrocarbons (e.g., straight chain alkanes or paraffinic hydrocarbons, branched-chain alkanes, unsaturated hydrocarbons, halogenated hydrocarbons, and alicyclic hydrocarbons), bio-phase change materials derived from fatty acids and their derivatives, (e.g., alcohols, amines, esters, and the like), hydrated salts (e.g., calcium chloride hexahydrate, calcium bromide hexahydrate, magnesium nitrate hexahydrate, lithium nitrate trihydrate, potassium fluoride tetrahydrate, ammonium alum, magnesium chloride hexahydrate, sodium carbonate decahydrate, disodium phosphate dodecahydrate, sodium sulfate decahydrate, and sodium acetate trihydrate), waxes, oils, water, fatty acids, fatty acid esters, dibasic acids, dibasic esters, 1-halides, primary alcohols, aromatic compounds, clathrates, semi-clathrates, gas clathrates, anhydrides (e.g., stearic anhydride), ethylene carbonate, polyhydric alcohols (e.g., 2,2-dimethyl-1,3-propanediol, 2-hydroxymethyl-2-methyl-1,3-propanediol, ethylene glycol, polyethylene glycol, pentaerythritol, dipentaerythritol, pentaglycerine, tetramethylol ethane, neoptyl glycol, tetramethylol propane, 2-amino-2-methyl-1,3-propanediol, monoaminopentaerythritol, diaminopentaerythritol, and tris(hydroxyrnethyl)acetic acid), polymers (e.g., polyethylene, polyethylene glycol, polyethylene oxide, polypropylene, polypropylene polytetramethylene glycol, polypropylene malonate, polyneopentyl glycol sebacate, polypentane glutarate, polyvinyl myristate, polyvinyl stearate, polyvinyl laurate, polyhexadecyl methacrylate, polyoctadecyl methacrylate, polyesters produced by polycondensation of glycols (or their derivatives) with diacids (or their derivatives), and copolymers, such as polyacrylate or poly(meth)acrylate with alkyl hydrocarbon side chain or with polyethylene glycol side chain and copolymers comprising polyethylene, polyethylene glycol, polyethylene oxide, polypropylene, polypropylene glycol, or polytetramethylene glycol), metals, and mixtures thereof. Bio-phase change materials have high latent heat, small volume change for phase transition, sharp well-defined melting temperature and reproducible behavior.

The selection of a phase change material will typically be dependent upon a desired transition temperature. For example, a phase change material having a transition temperature slightly above room temperature but below skin temperature may be desirable for mattress applications to maintain a comfortable temperature for a user.

A suitable phase change material can have a phase transition temperature within a range of about 22° to about 40° C. In one or more other embodiments, the transition temperature within a range of about 26° C. to about 30° C. With regard to paraffin phase change materials, the number of carbon atoms of a paraffinic hydrocarbon typically correlates with its melting point. For example, n-octacosane, which contains twenty-eight straight chain carbon atoms per molecule, has a melting point of 61.4° C. whereas n-tridecane, which contains thirteen straight chain carbon atoms per molecule, has a melting point of −5.5° C. According to an embodiment of the invention, n-octadecane, which contains eighteen straight chain carbon atoms per molecule and has a melting point of 28.2° C., is particularly desirable for mattress applications.

Other useful phase change materials include polymeric phase change materials having transition temperatures within a range of about 22° to about 40° C. in one or more embodiments, and a transition temperature within a range of about 26° to about 30° C. in other embodiments. A polymeric phase change material may comprise a polymer (or mixture of polymers) having a variety of chain structures that include one or more types of monomer units. In particular, polymeric phase change materials may include linear polymers, branched polymers (e.g., star branched polymers, comb branched polymers, or dendritic branched polymers), or mixtures thereof. A polymeric phase change material may comprise a homopolymer, a copolymer (e.g., terpolymer, statistical copolymer, random copolymer, alternating copolymer, periodic copolymer, block copolymer, radial copolymer, or graft copolymer), or a mixture thereof. As one of ordinary skill in the art will understand, the reactivity and functionality of a polymer may be altered by addition of a functional group such as, for example, amine, amide, carboxyl, hydroxyl, ester, ether, epoxide, anhydride, isocyanate, silane, ketone, and aldehyde. Also, a polymer comprising a polymeric phase change material may be capable of crosslinking, entanglement, or hydrogen bonding to increase its toughness or its resistance to heat, moisture, or chemicals.

According to some embodiments of the invention, a polymeric phase change material may be desirable as a result of having a higher molecular weight, larger molecular size, or higher viscosity relative to non-polymeric phase change materials (e.g., paraffinic hydrocarbons). In addition to providing thermal regulating properties, a polymeric phase change material may provide improved mechanical properties (e.g., ductility, tensile strength, and hardness).

For example, polyethylene glycols may be used as the phase change material in some embodiments of the invention. The number average molecular weight of a polyethylene glycol typically correlates with its inciting point. For instance, a polyethylene glycol having a number average molecular weight range of 570 to 630 (e.g., Carbowax 600) will have a melting point of 20° to 25° C., making it desirable for mattress applications. Further desirable phase change materials include polyesters having a melting point in the range of 22° to 40° C. that may be formed, for example, by polycondensation of glycols (or their derivatives) with diacids (or their derivatives).

According to some embodiments, a polymeric phase change material having a desired transition temperature may be formed by reacting a phase change material (e.g., an exemplary phase change material discussed above) with a polymer (or mixture of polymers). Thus, for example, n-octadecylic acid (i.e., stearic acid) may be reacted or esterified with polyvinyl alcohol to yield polyvinyl stearate, or dodecanoic acid (i.e., lauric acid) may be reacted or esterified with polyvinyl alcohol to yield polyvinyl laurate. Various combinations of phase change materials (e.g., phase change materials with one or more functional groups such as amine, carboxyl, hydroxyl, epoxy, silane, sulfuric, and so forth) and polymers may be reacted to yield polymeric phase change materials having desired transition temperatures.

In addition to the PCM or by itself, the panel can include thermoelectric elements that provide a Peltier effect or can include thermally conductive materials. For example, thermally conductive materials such as metals can be used, e.g., silver, gold, carbon, and the like. Particles of the thermally conductive materials can be deposited onto the first panel or at about a selected surface of the filler material that is positioned proximate to one of the panels.

The second panel provides comfort and warmth, which can be fabricated from a naturally comforting material allowing proper warmth of the sleeper. The second panel and/or a portion of the filler material proximate to the second panel can include a plurality of resistive heating elements or embedded chemistry configured to provide warmth during use.

In one or more embodiments, in accordance with the principle of the present in disclosure, the reversible mattress topper can further include stylized indicia to enable the end user to visually determine which surface of the mattress topper is configured to provide cooling and which surface of the mattress topper is configured to provide a comforting sensation without cooling and in some embodiments, provide active warming to the end user. The indicia can act as directions for orientation of the topper onto the mattress.

The thickness of the reversible mattress topper is generally from about 0.25 inches to about 4 inches. In one or more embodiments, the thickness of the reversible mattress topper is from about 0.5 inches to about 3 inches in thickness, and in still one or more embodiments, the thickness of the reversible mattress topper is from about 0.5 to about 2 inches in thickness.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A reversible mattress topper comprising:

a first surface defined by a first panel, wherein the first surface is configured to provide a cooling effect to an end user in contact therewith;

a second surface defined by a second panel opposing and underlying the first surface that does not provide the cooling effect;

a filler material comprising a first open cell foam layer and a second closed cell foam layer intermediate the first and second panels, wherein the first open cell foam layer includes an uppermost surface proximate to the first panel and the second closed cell foam layer includes a lowermost surface proximate to the second panel, wherein the first open cell foam layer is configured to permit airflow therethrough to enhance the cooling effect, and the second closed cell foam layer is configured to inhibit airflow to enhance heat retention, wherein the filler material uppermost surface comprises cooling chemistry thereon effective to provide the cooling effect to the first panel, wherein the first and second panels overlaying the filler material are free of the cooling chemistry, wherein the cooling chemistry is present exclusively on the uppermost surface of the first open cell foam layer and is absent from both the first and second panel, wherein the second panel and/or the filler material lowermost surface proximate to the second panel comprises a plurality of resistive heating elements configured to warm the second surface, and wherein the second panel and/or a portion of the filler material proximate to the second panel comprises a plurality of resistive heating elements, wherein the resistive heating elements are embedded within the closed cell foam layer and are electrically isolated from the open cell foam layer; and a zipper extending about at least a portion of the perimeter of the reversible mattress topper, wherein the zipper provides a closable opening between the first and second panels such that the filler material is removable and the first and second panels washable, wherein the reversible topper has a thickness of 0.25 inches to 3 inches and is configured to overlay a mattress assembly.

2. The reversible mattress topper of claim 1, further comprising indicia on the first and second surface, wherein the indicia is indicative of cooling provided by the first surface and warmth provided by the second surface.

3. The reversible mattress topper of claim 1, wherein the first open cell and second closed cell foam layers have different thicknesses.

4. The reversible mattress topper of claim 1, further comprising a gusset material extending between the first and second panels, wherein the gusset material includes a zipper extending about at least a portion of the perimeter of the reversible mattress topper, wherein the zipper provides an opening within the gusset material to an interior of the reversible mattress topper.

5. The reversible mattress topper of claim 1, further comprising a gusset material attached to a selected on of the first and second panels and a zipper configured to be attached to the other one of the first and second panels, wherein the zipper extends about at least a portion of the perimeter of the reversible mattress topper and provides an opening within the gusset material to an interior of the reversible mattress topper.

6. The reversible mattress topper of claim 1, further comprising an elastic anchoring band extending about each corner of the reversible mattress topper, wherein each elastic anchoring band corresponds to a respective corner of an underlying mattress assembly for securement of the reversible mattress topper to the underlying mattress when in use.

7. The reversible mattress topper of claim 1, wherein the second panel and/or the filler material lowermost surface proximate to the second panel comprises embedded additives or a coating thereon configured to warm the second surface when in use.

8. The reversible mattress topper of claim 1, wherein the first panel or the filler material uppermost surface proximate to the first panel comprises thermal conductive materials integrated therein.

9. The reversible mattress topper of claim 1, wherein the first panel comprises a phase change material deposited thereon.

10. The reversible mattress topper of claim 1, wherein the first panel comprises a fabric comprising fibers and phase change material coupled to the fibers.

11. The reversible mattress topper of claim 1, wherein the cooling chemistry comprises a phase change material.

12. The reversible mattress topper of claim 11, wherein the phase change material has a melting point in a range of about 22° C. to about 40° C.

* * * * *